US005258355A

United States Patent [19]

Bloodworth et al.

[11] Patent Number: 5,258,355

[45] Date of Patent: Nov. 2, 1993

[54] ACCEPTOR ELEMENT FOR THERMOSUBLIMATION PRINTING

[75] Inventors: Robert Bloodworth; Wolfgang Podszun, both of Cologne; Heinrich Alberts, Odenthal, all of Fed. Rep. of Germany; Hermann Uytterhoeven, Bonheiden, Belgium

[73] Assignee: Agfa-Gevaert Aktiengesellschaft, Leverkusen

[21] Appl. No.: 828,034

[22] Filed: Jan. 30, 1992

[30] Foreign Application Priority Data

Feb. 13, 1991 [DE] Fed. Rep. of Germany ..... 4104294

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 4,990,485 2/1991 Egashira et al. ..... 503/227

*Primary Examiner*—B. Hamilton Hess

*Attorney, Agent, or Firm*—Connolly & Hutz

[57] ABSTRACT

A dye acceptor element for thermosublimation printing comprising a support and a dye acceptor layer containing a graft polymer of an unsaturated copolyester as the graft base and a vinyl copolymer as the graft shell is distinguished by high color density, high sharpness, good image stability and a minimal tendency towards adhesion to than dye-donor lint.

19 Claims, No Drawings

ACCEPTOR ELEMENT FOR THERMOSUBLIMATION PRINTING

This invention relates to a dye acceptor element for thermosublimation printing.

Printouts of video- or computer-stored images can be made by a number of methods among which thermosublimation printing has proved to be superior for certain requirements by virtue of its advantages over other processes. This recording method is based on the heat-induced transfer of a dye from a sheet-form or web-form dye donor to a dye acceptor layer and is described, for example, in "High Quality Image Recording by Sublimation Transfer Recording Material", Electronic Photography Association Documents 27 (2), 1988 and in the literature cited therein. A particular advantage of this printing process is that it enables color intensity to be finely graduated.

Dye acceptor elements for thermosublimation printing usually comprise a support, for example paper or transparent films, which is coated with the actual dye acceptor layer. A binder layer can be arranged between the support and the acceptor layer.

Polymers of different classes may be used as the material for the dye acceptor layer.

Thus, the following examples of suitable materials for the acceptor layer are mentioned in EP-A-0 234 563:

1. synthetic resins containing ester compounds, such as polyesters, polyacrylates, polyvinyl acetate, styrene/acrylate resins and vinyl toluene/acrylate resins
2. polyurethanes
3. polyamides
4. urea resins
5. synthetic resins containing other highly polar bonds, such as polycaprolactam, polyvinyl chloride, vinyl chloride/vinyl acetate copolymers and polyacrylonitrile.

Polycarbonate, polyurethane, polyester, polyvinyl chloride, poly(styrene-co-acrylonitrile), polycaprolactone and mixtures thereof are mentioned as materials for the dye acceptor layer in U.S. Pat. No. 4,705,522.

Dye acceptor layers of copolyesters are described in detail in European patent applications EP-A-0 261 505, EP-A-0 275 319, EP-A-0 289 161 and EP-A-0 368 318. In addition, acceptor layers based on graft copolymers containing polysiloxane segments, fluorocarbon segments or long-chain alkyl segments are disclosed in EP-A-0 368 320.

The dye acceptor layers available at the present time are not yet entirely satisfactory in regard to high color density, high image stability and good resolution. It is particularly difficult in this regard to achieve high color density and adequate image stability for minimal lateral diffusion.

Another difficulty lies in the tendency of known receptor materials to adhere to the dye donor material.

The problem addressed by the present invention was to provide a dye acceptor element for thermosublimation printing which would not have any of the disadvantages described above. This problem has been solved by the use of a special graft polymer in the acceptor element.

The present invention relates to a dye acceptor material for thermosublimation printing comprising a support and a dye acceptor layer, characterized in that the dye acceptor layer is a graft polymer of an unsaturated copolyester as the graft base and a vinyl copolymer as the graft shell.

The graft shell preferably contains polymerized units of aromatic vinyl compounds and/or (meth)acrylates containing 1 to 3 carbon atoms in the alcohol radical.

In a particularly preferred embodiment, the graft shell consists of a vinyl copolymer of a) 10 to 80% by weight aromatic vinyl compound and/or (meth)acrylates containing 1 to 3 carbon atoms in the alcohol radical and
b) 20 to 90% by weight other vinyl monomers.

In a more particularly preferred embodiment, component b of the graft shell consists of b1) 10 to 70% by weight (meth)acrylates containing 4 to 18 carbon atoms in the alcohol radical
b2) 5 to 40% by weight (meth)acrylonitrile
b3) 0 to 30% by weight other vinyl monomers.

The ratio by weight of the graft base to the graft shell is generally from 10:1 to 1:5 and preferably from 5:1 to 1:3.

The unsaturated copolyester of the graft base consists of condensed residues of diols, dicarboxylic acids and, optionally, hydroxycarboxylic acids, with the proviso that 0.2 to 30 mol-% of the condensed residues contain polymerizable double bonds.

Both aliphatic and aromatic diols may be used. Examples of aliphatic diols are ethylene glycol, diethylene glycol, triethylene glycol, tetraethylene glycol, propane-1,2-diol, propane-1,3-diol, butane-1,4-diol, neopentyl glycol, hexane-1,2-diol, hexane-1,6-diol, cyclohexane-1,4-diol, cyclohexane-1,4-dimethanol, 2,2'-bis-(4-hydroxycyclohexyl)-propane. Other suitable diols are diols containing long alkyl chains, such as octane-1,8-diol, octane-1,2-diol, decane-1,2-diol, dodecane-1,2-diol, dodecane-1,12-diol, hexadecane-1,16-diol, eicosane-1,20-diol, glycerol monostearate, glycerol monolaurate and pentaerythritol distearate.

Examples of aromatic diols are bisphenol A, ethoxylated bisphenol A, propoxylated bisphenol A and p-xylylene glycol.

Suitable diols containing polymerizable double bonds are, for example, 2,3-dihydroxypropyl acrylate, 2,3-dihydroxypropyl methacrylate, pentaerythritol diacrylate, 9-octadecene-1,12-diol and glycerol monooleate.

The dicarboxylic acids may be aliphatic or aromatic. Suitable aromatic dicarboxylic acids are, for example, phthalic acid, terephthalic acid, isophthalic acid, sulfoisophthalic acid, naphthalene dicarboxylic acids and 2,2-bis-(p-carboxyphenyl)-propane.

Examples of aliphatic dicarboxylic acids are malonic acid, succinic acid, glutaric acid, adipic acid, sebacic acid, decane dicarboxylic acid, dodecyl malonic acid, octadecyl malonic acid, dodecyl succinic acid, tetradecyl succinic acid, hexadecyl succinic acid and octadecyl succinic acid. So-called dimer fatty acids which are derived from long-chain unsaturated monocarboxylic acids, for example the products registered under CAS Reg. Nos. 68783-41-5 and 68956-10-5, are also suitable.

Dicarboxylic acids containing polymerizable double bonds suitable for the invention are, for example, maleic acid, fumaric acid, itaconic acid, octenyl succinic acid, isooctenyl succinic acid, dodecyl succinic acid and docosenyl succinic acid. Maleic acid is preferred.

Suitable hydroxycarboxylic acids are, for example, 12-hydroxystearic acid, 12-hydroxy-9-octadecenoic acid and ricinoleic acid.

5 to 45 mol-% of the condensed residues preferably contain one or more aromatic groups.

The polyesters used as graft base for the present invention may be synthesized by various condensation processes known per se. Polycondensation at elevated temperature in the melt is particularly suitable. Interfacial condensation may also be used.

The diols and dicarboxylic acids need not be directly used as starting compounds, instead corresponding derivatives may be used. For example, epoxides or acetates may be used instead of the diols and esters instead of the dicarboxylic acids.

It may be useful to add polymerization inhibitors, such as 2,5-di-tert. butyl phenol, during the condensation reaction to prevent a crosslinking reaction.

The molecular weights of the polyesters are generally in the range from 1,000 to 30,000.

A hydrophilicizing group, such as for example a carboxylate group, a sulfonate group, an alcoholate group or a polyethylene oxide group, may be incorporated in the polyester to make it dispersible in water. This may be done, for example, by using sulfoterephthalic acid, sulfoisophthalic acid or sulfo-orthophthalic acid.

Aromatic vinyl compounds (component a) suitable for the purposes of the invention are styrene, α-methyl styrene, p-methyl styrene, m-methyl styrene, p-tert. butyl styrene, p-chlorostyrene, p-chloromethyl styrene, vinyl naphthalene and vinyl naphthalene. Styrene is preferred.

(Meth)acrylates are understood to be esters of methacrylic and acrylic acid. (Meth)acrylates containing 1 to 3 carbon atoms in the alcohol component are methyl acrylate, methyl methacrylate, ethyl acrylate, ethyl methacrylate, propyl acrylate, propyl methacrylate, isopropyl acrylate and isopropyl methacrylate.

The (meth)acrylates containing 4 to 18 carbon atoms (component b1) are derived from optionally substituted aliphatic, cycloaliphatic, aromatic or mixed aromatic-/aliphatic alcohols. The aliphatic radicals may be both linear and branched and interrupted by oxygen.

Examples of suitable (meth)acrylates are n-butyl acrylate, n-butyl methacrylate, isobutyl acrylate, isobutyl methacrylate, n-hexyl acrylate, n-hexyl methacrylate, ethylhexyl acrylate, ethylhexyl methacrylate, n-octyl acrylate, n-octyl methacrylate, decyl acrylate, decyl methacrylate, stearyl acrylate, stearyl methacrylate, cyclohexyl acrylate, cyclohexyl methacrylate, 4-tert. butyl cyclohexyl methacrylate, benzyl acrylate, benzyl methacrylate, phenylethyl acrylate, phenylethyl methacrylate, phenylpropyl acrylate, phenylpropyl methacrylate, phenyloctyl acrylate, phenylnonyl acrylate, phenylnonyl methacrylate, 3-methoxybutyl methacrylate, butoxyethyl acrylate, furfuryl methacrylate and tetrahydrofurfuryl acrylate.

Mixtures of different esters may of course also be used. Mixtures containing ethylhexyl acrylate, decyl methacrylate, dodecyl methacrylate or phenylethyl acrylate are particularly suitable.

The term (meth)acrylonitrile (component b2) is intended to encompass both methacrylonitrile and acrylonitrile.

Suitable other monomers (component b3) are vinylidene chloride, vinyl chloride, vinyl acetate, vinyl propionate, vinyl laurate and vinyl adipate. Hydrophilic monomers may be used to ensure good dispersibility in water and include, for example, sulfoethyl methacrylate, acrylamidomethyl sulfonic acid, (meth)acrylic acid, hydroxyethyl (meth)acrylate and monomers containing ethylene oxide, such as tetraethylene glycol mono(meth)acrylate.

The procedure adopted to carry out the grafting reaction is described in detail in the literature, for example in Houben-Weyl, Methoden der Organischen Chemie, Vol. E20/Part 1, pages 626 et seq. The reaction is initiated with radical formers, preferably peroxides.

The reaction may be carried out in homogeneous phase as bulk or solution polymerization or in heterogeneous phase as emulsion polymerization. An emulsion polymerization process using sodium alkylsulfonate as emulsifier and potassium peroxydisulfate as initiator is particularly suitable for the production of the graft polymers according to the invention.

Suitable support materials for the acceptor layer according to the invention are both papers, particularly synthetic papers and polymer-coated papers, and films based, for example, on polyester, polyamide, polyvinyl chloride or polycarbonate.

In addition to the acceptor layer according to the invention, the receptor element may of course contain other layers known for this purpose. Thus, an adhesive layer may be applied over the acceptor layer. Suitable adhesive layers are, for example, low molecular weight and high molecular polysiloxanes and also polysiloxane/polyether block copolymers. To improve the adhesion of the acceptor layer to the support material, an interlayer, for example of gelatine, may be applied.

The graft polymers may be processed from solution or, preferably, from aqueous dispersion. Suitable solvents are, for example, acetone, methyl ethyl ketone, tetrahydrofuran, dioxane, ethyl acetate, dichloromethane and dimethyl formamide. The solution or dispersion may be applied to the support by casting or knife-coating.

The dye acceptor material according to the invention may be combined with the dye donor elements typically encountered in thermosublimation printing. The donor material and acceptor material show no tendency to adhere to one another. The dye images obtained are distinguished by high resolution, high color saturation, high brilliance and good long-term stability.

EXAMPLE 1

Production of an Unsaturated Polyester

A mixture of 0.400 mol terephthalic acid dimethyl ester, 0.400 mol isophthalic dimethyl ester, 0.150 mol 5-sulfoisophthalic acid dimethyl ester sodium salt, 0.05 mol maleic acid and 1 mol 1,10-decanediol was melted together with 0.0002 mol zinc acetate and 0.0001 mol antimony(III) oxide and the resulting melt was stirred under nitrogen at 200° C. in a reactor.

The esterification reaction began quickly and methanol was distilled off, initially under normal pressure. The reaction product was then further condensed under reduced pressure at 200° to 250° C. until the expected degree of polymerization had been reached (approx. 60 to 120 mins.). The yield amounted to 100%.

EXAMPLES 2-9

Other unsaturated polyesters were synthesized by the method described in Example 1. The units on which the starting components used are based are listed in Table 1.

TABLE 1

| Example No. | Starting components [mol-%] | | | | | |
|---|---|---|---|---|---|---|
| 1 | 40 TPA | 40 IPA | 15 SIPA | 5 MAL | | 100 DD |
| 2 | 40 TPA | 35 TPA | 15 SIPA | 10 MAL | | 100 DD |
| 3 | 40 TPA | 30 IPA | 15 SIPA | 20 MAL | 50 EG | 50 DD |
| 4 | 40 TPA | 25 IPA | 15 SIPA | 10 MAL<br>10 ODSUC | 80 EG | 20 DIA |
| 5 | 45 TPA | 30 IPA | 15 SIPA | 10 MAL | 80 EG | 20 HDD |
| 6 | 35 TPA | | 15 SIPA | 50 ITAC | 50 EG | 50 DD |
| 7 | 45 TPA | 40 IPA | 15 SIPA | | 90 EG | 10 GMO |
| 8 | 45 TPA | 15 IPA | 15 SIPA | 25 OSUC | 80 EG | 20 DIA |
| 9 | 45 TAP | 30 IPA | 15 SIPA | 10 DOLSUC | 80 EG | 20 DIA |

The figures in the Table represent the percentage content of the diol or dicarboxylic acid residues in mol-%, based on the total diol or dicarboxylic acid content.

| Meanings of the abbreviations: | | | |
|---|---|---|---|
| TPA | terephthalic acid | EG | ethylene glycol |
| IPA | isophthalic acid | DD | decane-1,10-diol |
| SIPA | 5-sulfoisophthalic acid Na salt | HDD | hexadecane-1,2-diol |
| MAL | maleic acid | GMO | glycerol monooleate |
| ITAC | itaconic acid | DIA | Dianol 22 (Akzo), ethoxylated bisphenol A |
| OSUC | octenyl succinic | | |
| ODSUC | octadecenyl succinic acid | | |
| DOLSUC | docosenyl succinic acid | | |

EXAMPLES 10–30

Production of Graft Polymers 3 g of the unsaturated polyesters of Examples 1 to 9 are dispersed in 30 g distilled water at room temperature. The dispersion is purged with nitrogen and heated to 70° C. 10% of inflow 1 and 0.05 g potassium peroxydisulfate are then added. The temperature is increased to 75° C. and the rest of inflow 1 and inflow 2 were uniformly introduced over a period of 4 hours. On completion of the addition, another 0.02 g potassium peroxydisulfate is added, followed by stirring for 4 hours at 75° C.:

Inflow 2: 2% aqueous solution of octadecyl sulfonic acid Na salt

S: Styrene, EHA: ethylhexyl acrylate, AN: acrylonitrile, DMA: decyl methacrylate, MAN: methacrylonitrile, MMA: methyl methacrylate, VDC: vinylidene chloride

EXAMPLES 31–52

Production and Testing of Acceptor Elements

The graft polymer dispersions obtained in Examples 10 to 30 were adjusted with deionized water to a solids content of 10% and directly used for the production of dye receptor layers.

The 10% graft polymer dispersions were knife-coated in a wet film thickness of 50 μm hardened-gelatine-coated polyethylene paper. The coatings were dried at room temperature and then heated for 15 minutes at 90° C. The dry layer thicknesses were approx. 4.5 μm.

Test images were produced on the receptor elements obtained with a Mitsubishi CP-100 E video printer using a Mitsubishi CK-100 S dye cassette. The color intensity was determined by microdensitometry. The figures shown are the black-and-white densities measured on a black surface of the test image without a filter.

Image sharpness was visually evaluated immediately after printing, after storage for 3 days at room temperature and after storage for 3 days at 57° C./35% relative air humidity.

TABLE 2

| Example | Polyester | Inflow 1 Composition in % | | | Inflow 1 [g] | Inflow 2 [g] |
|---|---|---|---|---|---|---|
| 10 | Example 1 | 50 S, | 25 AN, | 25 EHA | 6 | 15 |
| 11 | Example 2 | 50 S, | 25 AN, | 25 EHA | 9 | 15 |
| 12 | Example 1 | 47 S, | 23 AN, | 30 DMA | 3 | 10 |
| 13 | Example 1 | 47 S, | 23 AN, | 30 DMA | 1.3 | 10 |
| 14 | Example 1 | 50 S, | 25 AN, | 25 DMA | 3 | 10 |
| 15 | Example 2 | 50 S, | 25 AN, | 25 EHA | 6 | 15 |
| 16 | Example 3 | 50 S, | 25 AN, | 25 EHA | 6 | 15 |
| 17 | Example 4 | 50 S, | 25 AN, | 25 EHA | 6 | 15 |
| 18 | Example 4 | 50 S, | 25 AN, | 25 EHA | 9 | 15 |
| 19 | Example 4 | 56 S, | 19 AN, | 25 EHA | 3 | 10 |
| 20 | Example 4 | 56 S, | 19 AN, | 25 EHA | 6 | 15 |
| 21 | Example 4 | 56 S, | 19 AN, | 25 EHA | 9 | 15 |
| 22 | Example 4 | 47 S, | 23 AN, | 30 EHA | 9 | 15 |
| 23 | Example 5 | 50 S, | 25 AN, | 25 EHA | 6 | 15 |
| 24 | Example 5 | 50 S, | 25 AN, | 25 EHA | 9 | 15 |
| 25 | Example 5 | 43 S, | 27 AN, | 30 EHA | 3 | 10 |
| 26 | Example 5 | 43 S, | 27 AN, | 30 EHA | 1.7 | 10 |
| 27 | Example 6 | 50 S, | 25 MAN, | 25 EHA | 6 | 10 |
| 28 | Example 7 | 50 S, | 25 AN, | 25 EHA | 6 | 10 |
| 29 | Example 8 | 50 MMA, | 25 AN, | 25 EHA | 6 | 10 |
| 30 | Example 9 | 50 S,<br>10 VDC | 25 AN, | 5 EHA | 6 | 10 |

| Example No. | Graft pol. Example | Tackiness | Sharpness after printing | Sharpness after storage | Density |
|---|---|---|---|---|---|
| 31 | 10 | 0 | ++ | ++ | 2.11 |
| 32 | 11 | 1 | ++ | ++ | 2.02 |
| 33 | 12 | 0 | ++ | ++ | 2.19 |
| 34 | 13 | 0 | ++ | ++ | 2.28 |
| 35 | 14 | 0 | ++ | ++ | 2.31 |
| 36 | 15 | 0 | ++ | + | 1.96 |
| 37 | 16 | 0 | ++ | + | 1.84 |
| 38 | 17 | 1 | ++ | ++ | 1.74 |
| 39 | 18 | 1 | ++ | ++ | 1.76 |
| 40 | 19 | 1 | ++ | ++ | 1.83 |
| 41 | 20 | 1 | ++ | ++ | 1.76 |
| 42 | 21 | 1 | ++ | ++ | 1.73 |
| 43 | 22 | 1 | ++ | ++ | 1.75 |
| 44 | 23 | 0 | ++ | ++ | 1.86 |
| 45 | 24 | 1 | ++ | ++ | 1.80 |
| 46 | 25 | 1 | ++ | ++ | 1.83 |
| 47 | 26 | 1 | ++ | ++ | 1.93 |
| 48 | 27 | 0 | ++ | ++ | 1.90 |
| 49 | 28 | 1 | ++ | ++ | 1.92 |
| 50 | 29 | 1 | ++ | ++ | 1.82 |
| 51 | 30 | 0 | ++ | ++ | 1.95 |
| 52 (Comparison test without grafting) | 1 | 3 | Cannot be evaluated | | |

++ very good
+ good
0 no tackiness
1 very slight tackiness
2 slight tackiness
3 pronounced tackiness (the donor material and acceptor material adhere completely or partly to one another after printing)

We claim:

1. A dye acceptor material for thermosublimation printing comprising a support and a dye acceptor layer, characterized in that the dye acceptor layer is a graft polymer of an unsaturated copolyester as the graft base and a vinyl copolymer as the graft shell.

2. A dye acceptor material as claimed in claim 1, characterized in that the unsaturated copolyester consists of condensed residues of diols, dicarboxylic acids and, optionally, hydroxycarboxylic acids, further wherein 0.2 to 30 mol-% of the condensed residues contain polymerizable double bonds.

3. A dye acceptor material as claimed in claim 2, characterized in that 5 to 45 mol-% of the condensed residues contain one or more aromatic groups.

4. A dye acceptor material as claimed in claim 1, characterized in that the vinyl copolymer is synthesized from a) 10 to 80% by weight of at least one of an aromatic vinyl compound and (meth)acrylates containing 1 to 3 carbon atoms in the alcohol radical and b) 20 to 90% by weight of other vinyl monomers.

5. A dye acceptor material as claimed in claim 4, characterized in that the vinyl copolymer is synthesized from a) 10 to 80% by weight of at least one of an aromatic vinyl compound and (meth)acrylates containing 1 to 3 carbon atoms in the alcohol radical;

b1) 10 to 70% by weight of (meth)acrylates containing 4 to 18 carbon atoms in the alcohol radical;

b2) 5 to 40% by weight of (meth)acrylonitrile; and b3) 0 to 30% by weight of other vinyl monomers.

6. A dye acceptor material as claimed in claim 5, characterized in that component b3) comprises hydrophilic monomers.

7. A dye acceptor material as claimed in claim 6, wherein said hydrophilic monomers are selected from the group consisting of sulfoethylmethacrylate, acrylamidomethyl sulfonic acid, (meth)acrylic acid, hydroxyethyl (meth)acrylate and monomers containing ethylene oxide.

8. A dye acceptor material for thermosublimation printing comprising a support and a dye acceptor layer, wherein the dye acceptor layer is a graft polymer of an unsaturated copolyester as the graft base and a vinyl copolymer as the graft shell, further wherein said vinyl copolymer consists essentially of:

a) 10 to 80% by weight of an aromatic vinyl compound selected from the group consisting of styrene, α-methyl styrene, p-methyl styrene, m-methyl styrene, p-tert. butyl styrene, p-chlorostyrene, p-chloromethyl styrene and vinyl naphthalene;

b1) 10 to 70% by weight of (meth)acrylates containing 4 to 18 carbon atoms in the alcohol radical;

b2) 5 to 40% by weight of at least one of methacrylonitrile and acrylonitrile; and b3) 0 to 30% by weight of other vinyl monomers.

9. A dye acceptor material as claimed in claim 8, wherein the unsaturated copolyester consists of condensed residues of diols, dicarboxylic acids and, optionally, hydroxycarboxylic acids, further wherein 0.2 to 30 mol % of the condensed residues contain polymerizable double bonds.

10. A dye acceptor material as claimed in claim 9, wherein the unsaturated polyester has a molecular weight of from 1,000 to 30,000.

11. A dye acceptor material as claimed in claim 8, wherein the aromatic vinyl compound is styrene.

12. A dye acceptor material as claimed in claim 8, wherein the (meth)acrylates containing 4 to 18 carbon atoms in the alcohol radical are selected from n-butyl acrylate, n-butyl methacrylate, isobutyl acrylate, isobutyl methacrylate, n-hexyl acrylate, n-hexyl methacrylate, ethylhexyl acrylate, ethylhexyl methacrylate, n-octyl acrylate, n-octyl methacrylate, decyl acrylate, decyl methacrylate, stearyl acrylate, stearyl methacrylate, cyclohexyl acrylate, cyclohexyl methacrylate, 4-tert. butyl cyclohexyl methacrylate, benzyl acrylate, benzyl methacrylate, phenylethyl acrylate, phenylethyl methacrylate, phenylpropyl acrylate, phenylpropyl methacrylate, phenyloctyl acrylate, phenylnonyl acrylate, phenylnonyl methacrylate, 3-methoxybutyl methacrylate, butoxyethyl acrylate, furfuryl methacrylate and tetrahydrofurfuryl acrylate.

13. A dye acceptor material as claimed in claim 8, wherein the other vinyl monomers are selected from vinylidene chloride, vinyl chloride, vinyl acetate, vinyl propionate, vinyl laurate and vinyl adipate.

14. A dye acceptor material for thermosublimation printing comprising a support and a dye acceptor layer, wherein the dye acceptor layer is a graft polymer of an unsaturated copolyester as the graft base and a vinyl copolymer as the graft shell, further wherein said vinyl copolymer consists essentially of:

a) 10 to 80% by weight of (meth)acrylates containing 1 to 3 carbon atoms in the alcohol radical;

b1) 10 to 70% by weight of (meth)acrylates containing 4 to 18 carbon atoms in the alcohol radical;

b2) 5 to 40% by weight of at least one of methacrylonitrile and acrylonitrile; and b3) 0 to 30% by weight of other vinyl monomers.

15. A dye acceptor material as claimed in claim 14, wherein the unsaturated copolyester consists of condensed residues of diols, dicarboxylic acids and, optionally, hydroxycarboxylic acids, further wherein 0.2 to 30 mol % of the condensed residues contain polymerizable double bonds.

16. A dye acceptor material as claimed in claim 14, wherein the unsaturated polyester has a molecular weight of from 1,000 to 30,000.

17. A dye acceptor material as claimed in claim 14, wherein the (meth)acrylates containing 1 to 3 carbon atoms in the alcohol radical are selected from the group consisting of methyl acrylate, methyl methacrylate, ethyl acrylate, ethyl methacrylate, propyl acrylate, propyl methacrylate, isopropyl acrylate and isopropyl methacrylate.

18. A dye acceptor material as claimed in claim 14, wherein the (meth)acrylates containing 4 to 18 carbon atoms in the alcohol radical are selected from n-butyl acrylate, n-butyl methacrylate, isobutyl acrylate, isobutyl methacrylate, n-hexyl acrylate, n-hexyl methacrylate, ethylhexyl acrylate, ethylhexyl methacrylate, n-octyl acrylate, n-octyl methacrylate, decyl acrylate, decyl methacrylate, stearyl acrylate, stearyl methacrylate, cyclohexyl acrylate, cyclohexyl methacrylate, 4-tert. butyl cyclohexyl methacrylate, benzyl acrylate, benzyl methacrylate, phenylethyl acrylate, phenylethyl methacrylate, phenylpropyl acrylate, phenylpropyl methacrylate, phenyloctyl acrylate, phenylnonyl acrylate, phenylnonyl methacrylate, 3-methoxybutyl methacrylate, butoxyethyl acrylate, furfuryl methacrylate and tetrahydrofurfuryl acrylate.

19. A dye acceptor material as claimed in claim 14, wherein the other vinyl monomers are selected from vinylidene chloride, vinyl chloride, vinyl acetate, vinyl propionate, vinyl laurate and vinyl adipate.

* * * * *